US007175255B2

(12) United States Patent
Okito et al.

(10) Patent No.: US 7,175,255 B2
(45) Date of Patent: Feb. 13, 2007

(54) INK JET RECORDING HEAD AND INK JET RECORDING APPARATUS

(75) Inventors: Kazuhiko Okito, Kanagawa (JP); Keiichiro Tsukuda, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 286 days.

(21) Appl. No.: 10/926,959

(22) Filed: Aug. 27, 2004

(65) Prior Publication Data

US 2005/0104931 A1 May 19, 2005

(30) Foreign Application Priority Data

Oct. 23, 2003 (JP) ..... 2003-363269

(51) Int. Cl.
*B41J 2/145* (2006.01)
*B41J 2/15* (2006.01)

(52) U.S. Cl. ..... 347/40; 347/47

(58) Field of Classification Search ..... None
See application file for complete search history.

(56) References Cited

U.S. PATENT DOCUMENTS 6,095,637 A * 8/2000 Hirabayashi et al. ..... 347/43
6,139,761 A 10/2000 Ohkuma

FOREIGN PATENT DOCUMENTS

| | | |
|---|---|---|
| EP | 0 244 643 A | 11/1987 |
| JP | 62-264957 A | 11/1987 |
| JP | 9-11479 A | 1/1997 |
| JP | 2718939 B | 11/1997 |

* cited by examiner

*Primary Examiner*—Thinh Nguyen
(74) *Attorney, Agent, or Firm*—Fitzpatrick, Cella, Harper & Scinto

(57) ABSTRACT

An ink jet recording head having a recording element substrate including three or more discharge port arrays comprising a plurality of discharge ports and recording elements for discharging ink from the discharge ports and supplying heat to areas around the discharge ports; wherein each of the discharge port arrays matches one or another of a plurality of types of ink whose viscosity decreases with a rise in temperature, and the discharge port arrays matching the most viscous of the inks to be discharged being arranged between other discharge port arrays to enable ink drips to be discharged stably, and an ink jet recording apparatus using the same are to be provided.

2 Claims, 9 Drawing Sheets

INK JET RECORDING HEAD AND INK JET RECORDING APPARATUS

BACKGROUND OF THE INVENTION

1. Field of the Invention

The present invention relates to an ink jet recording head and an ink jet recording apparatus for imprinting a plurality of different kinds of ink, such as inks of a plurality of colors, on a recording medium, such as paper.

2. Related Background Art

Among known ink jet recording heads for printing color images, there are so-called integrated multicolor type ink jet recording heads, in which a plurality of heat generating resistance devices (electrothermal conversion devices) matching (corresponding to) inks of a plurality of colors and densities are arranged on the same substrate, and nozzles and flow channels matching the respective heat generating resistance devices are also disposed on this substrate (e.g., the Japanese Patent No. 2718939).

In recent years, further improvement in picture quality, especially in terms of the definition and contrast of recorded pictures, has come to be required of color ink jet recording apparatuses. Known ways to meet this requirement include enhancing the definition of pictures by increasing the densities of dye of inks.

However, as the densities of dye of inks are increased, they become more viscous. Increased viscosity entails a slowdown in the refilling of nozzles with inks after they are discharged from the outlet. In short, the higher the densities of dye of inks, the slower the refilling after they are discharged from the outlet.

Therefore, where an ink of a density of dye exceeding a prescribed level of viscosity is used, ink drips may be discharged before the nozzle is fed with a sufficient quantity of ink, which would prevent stable discharging of ink drips.

At the same time, the viscosity of ink varies with the temperature and humidity of the external environment. If, for instance, the temperature or the humidity of the external environment is low, the ink will become more viscous, likely to make stable discharging of ink drips impossible.

Therefore, a color ink jet recording apparatus using inks of densities of dye exceeding a prescribed level of viscosity is more susceptible to inability to stably discharge ink drips when the temperature or the humidity of the external environment is low. Eventually, it may become impossible to normally form main drips of ink, or faulty discharging may occur as a consequence of the deviation of the discharging direction of ink drips from the designed discharging direction or a total failure to discharge ink drips.

SUMMARY OF THE INVENTION

An object of the present invention is to enhance the definition and contrast of recorded pictures by providing an ink jet recording head capable of stable discharging of ink drips even when inks of densities of dye exceeding a prescribed level of viscosity are used and an ink jet recording apparatus using the same.

Another object of the invention is to provide an ink jet recording head having a recording element substrate including three or more discharge port arrays comprising a plurality of discharge ports and recording elements for discharging ink from the discharge ports and supplying heat to areas around the discharge ports, wherein each of the discharge port arrays matches (corresponds to) one or another of a plurality of types of ink whose viscosity decreases with a rise in temperature, and the discharge port arrays matching the most viscous of the inks to be discharged are arranged between other discharge port arrays, and an ink jet recording apparatus using the same.

DESCRIPTION OF THE PREFERRED EMBODIMENTS

The invention to be described in detail below relates to an ink jet recording head intended to enhance the definition and contrast of recorded pictures, for instance, and capable of stably discharging ink drips even if inks whose densities of dye exceed a prescribed viscosity are used and an ink jet recording apparatus using the same.

One preferred embodiment of the invention will be described in detail below with reference to drawings.

(First Embodiment)

Figure 1:
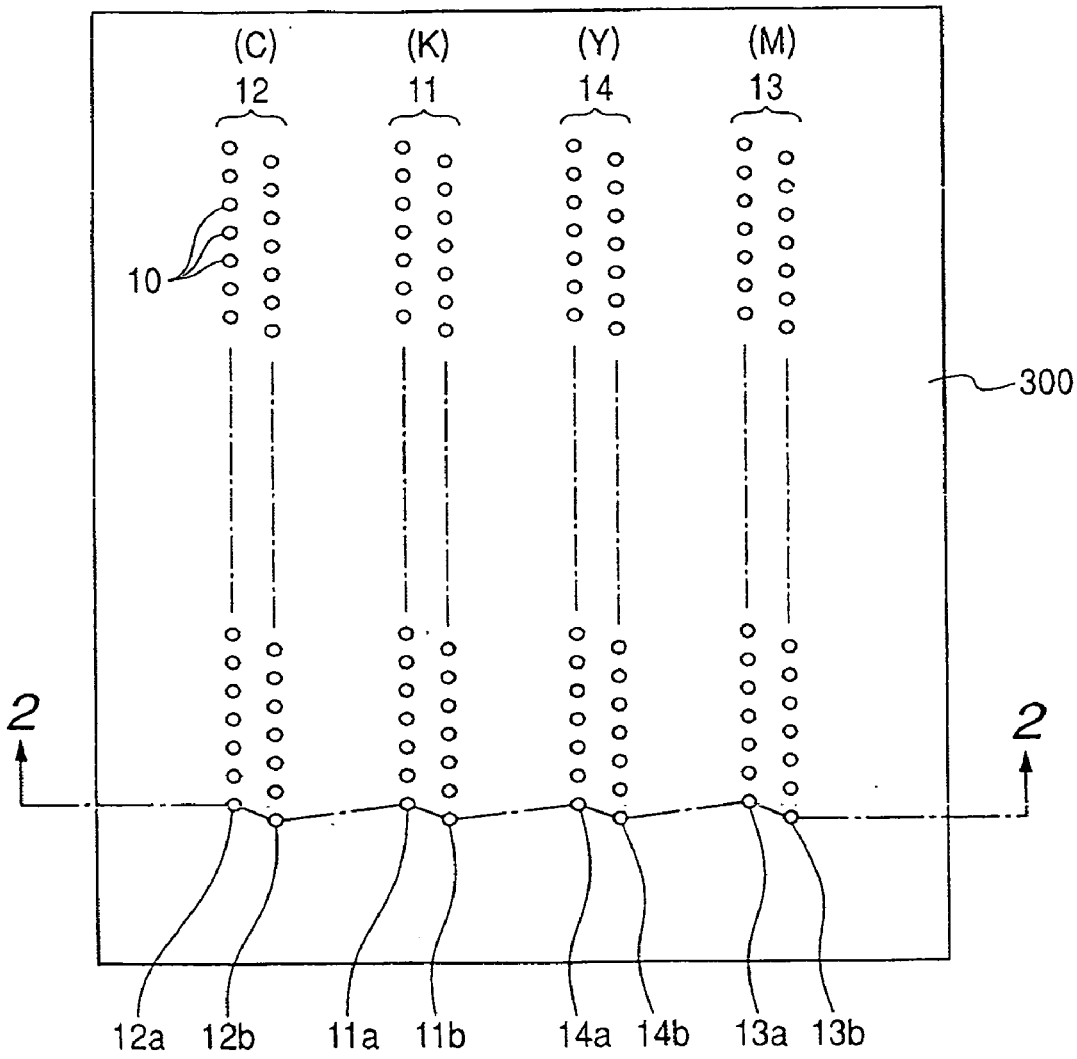
FIG. 1 illustrates one form of the essential part of an ink jet recording head, which is a first preferred embodiment of the present invention.
Figure 2:
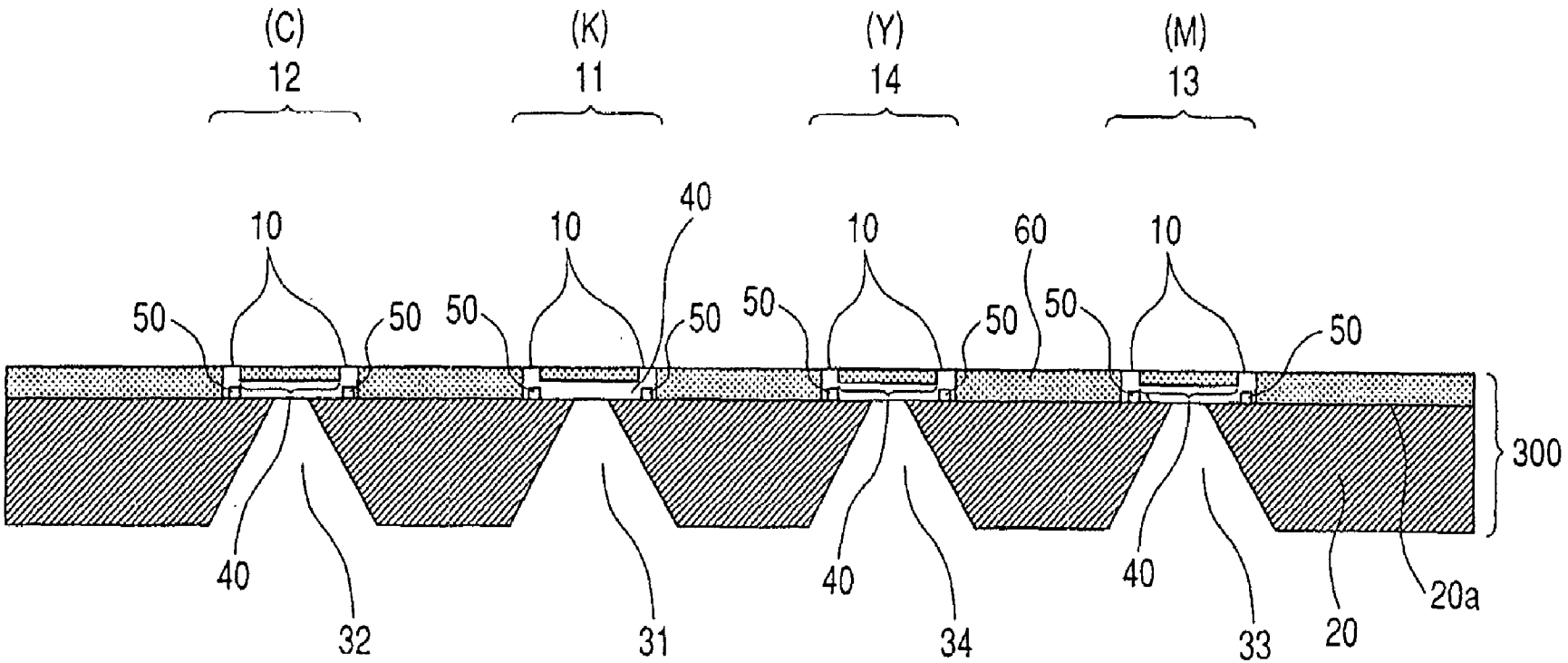
FIG. 2 shows a section of the essential part of the ink jet recording head shown in FIG. 1.

FIG. 1 and FIG. 2 schematically illustrate the essential part of an ink jet recording head, which is a first preferred embodiment of the invention. FIG. 1 shows a plan of the essential part of the ink jet recording head, and FIG. 2, a section along line 2—2 in FIG. 1.

Referring to FIG. 1, a recording element 6 substrate 300 as a first recording element substrate has a plurality of discharge port arrays 11, 12, 13 and 14, and each discharge port array comprises a plurality of discharge ports 10 arranged in the vertical scanning direction of the ink jet recording head.

The discharge port arrays 11, 12, 13 and 14 are so disposed as to be in a prescribed order in the recording element substrate 300. In this embodiment, incidentally, the discharge port arrays 11, 12, 13 and 14 are disposed in parallel to one another.

Each of the discharge port arrays 11, 12, 13 and 14 matches (corresponds to) one or another of a plurality of types of ink whose viscosity decreases with a rise in temperature. Each of the discharge ports 10 discharges drips of ink matched with the discharge port array to which the discharge port belongs.

The discharge port arrays 11 comprise a discharge port array 11*a* and a discharge port array 11*b*; the discharge port arrays 12 comprise a discharge port array 12*a* and a discharge port array 12*b*; the discharge port arrays 13 comprise a discharge port array 13*a* and a discharge port array 13*b*; and the discharge port arrays 14 comprise a discharge port array 14*a* and a discharge port arrays 14*b*.

Referring to FIG. 2, the recording element substrate 300 is provided with a substrate 20 over which heat generating resistance devices 50, which are both energy conversion devices and recording elements, are formed and an orifice plate 60, which is another substrate in which the discharge ports 10 are formed. Incidentally in FIG. 2, elements having the same configurations as in FIG. 1 are denoted by respectively the same reference signs.

The substrate 20 in this embodiment is formed of a silicon single crystal substrate of <100> in orientation, and over its contact face 20*a* with the orifice plate 60 are formed heat generating resistance devices 50 and electric wiring (not shown) of aluminum or some other material for supplying drive power to the heat generating resistance devices 50.

The substrate 20 is provided with four through holes 31 through 34 formed by anisotropic etching. The through hole 31 serves as an ink feed hole 31 for feeding ink in the liquid form to the discharge port arrays 11. The through hole 32 similarly serves as an ink feed hole 32 for feeding ink to the discharge port array 12; the through hole 33, as an ink feed hole 33 for feeding ink to the discharge port array 13; and the through hole 34, as an ink feed hole 34 for feeding ink to the discharge port array 14.

Incidentally, though this embodiment uses a silicon substrate of <100> in orientation as the substrate 20, the substrate 20 is not confined to a silicon substrate of <100> in orientation, but can be replaced with something else as appropriate. For instance, the substrate 20 may be a silicon substrate of <110> in orientation.

Where a silicon substrate of <110> in orientation is used as the substrate 20, when the substrate 20 is etched to form the ink feed holes 31 through 34, the etching proceeds perpendicularly to the substrate 20 (in the thickness direction of the substrate 20), ink feed holes whose sectional shape little varies in the thickness direction of the substrate 20 can be readily obtained. Therefore, the size of the substrate 20 can be determined on the basis of the size of the ink feed holes 31 through 34 to be bored into the substrate 20, and this feature facilitates a reduction in the size of the ink jet recording head.

Further in this embodiment, though the etching process facilitates the formation of the ink feed hole 31 through 34, the method of forming the ink feed hole 31 through 34 is not restricted to etching, but they can be formed in some other appropriate way. For instance, the ink feed holes 31 through 34 can as well be formed by sand blasting or laser irradiation.

The orifice plate 60 disposed over the contact face 20*a* of the substrate 20 is formed of photosensitive epoxy resin in this embodiment, and the discharge ports 10 and nozzles 40 are formed in positions matching the heat generating resistance devices 50 by a process described in the Japanese Patent Application Laid-Open No. S62-264957, for instance.

Incidentally, the recording element substrate 300 may as well be formed by, for instance, the method described in the Japanese Patent Application Laid-Open No. H9-11479. More specifically, after forming a silicon oxide film or a silicon nitride film over a silicon substrate as the substrate 20, ink feed holes are bored into the substrate 20 in a state in which the film is left as is; then the orifice plate 60 is disposed over the film; then, the silicon oxide film or the silicon nitride film present in the ink feed holes is removed; and through holes, discharge ports and nozzles are formed in the orifice plate 60. In this way, precise ink jet recording heads can be fabricated at low cost. Therefore, it is desirable to form the recording element substrate 300 by this method.

The recording element substrate 300 having the substrate 20 and the orifice plate 60 discharges ink or some other liquid out of the discharge ports 10 by utilizing the pressure of bubbles generated by the membrane boiling of the liquid by the thermal energy supplied from the heat generating resistance devices 50 to the nozzles 40, and thereby performs recording.

Incidentally, the thermal energy supplied from the heat generating resistance devices 50 to ink or some other liquid is also supplied to the areas around the discharge ports 10, which discharge the liquid such as ink, in the recording element substrate 300. Therefore, the area around each of the discharge ports 10 (hereinafter referred as simply "the discharge port(s)" or "the discharge port array(s)") can be deemed to be a new heat source for its surroundings.

Figure 3A:
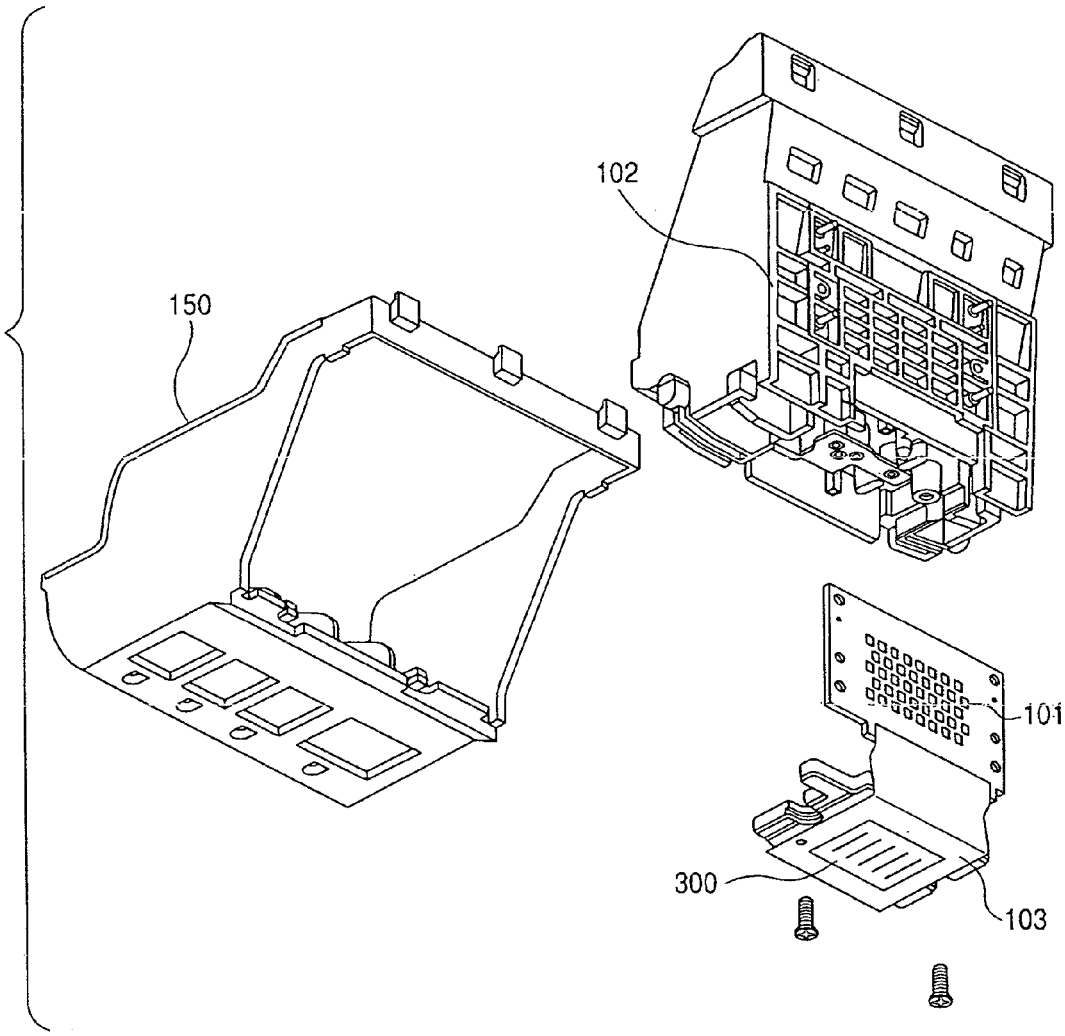
FIGS. 3A and 3B illustrate one example of the ink jet recording head, which is the first preferred embodiment of the invention.
Figure 3B:
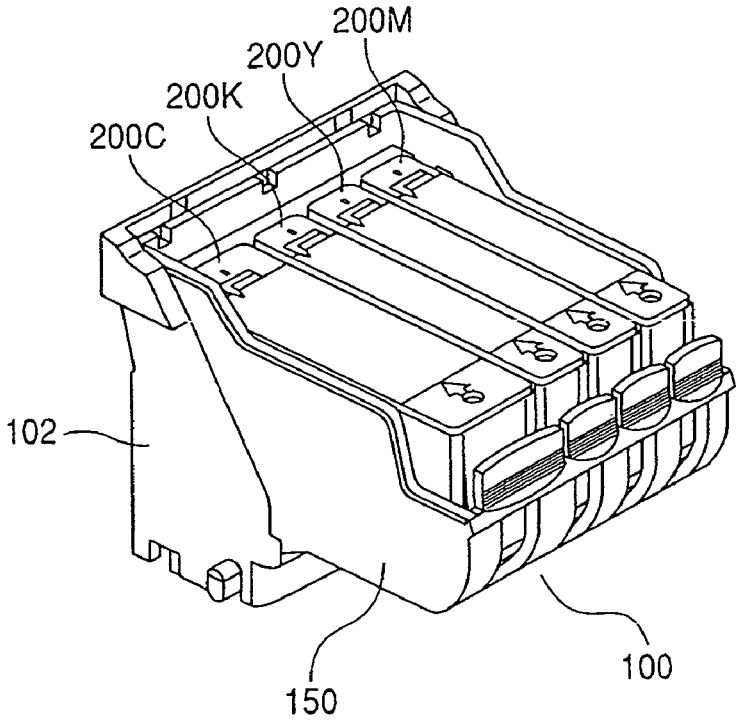

FIGS. 3A and 3B schematically illustrate the essential part of the ink jet recording apparatus provided with the recording element substrate 300 or, more specifically, the ink jet recording head equipped with the recording element substrate 300.

FIG. 3A shows a perspective view of the essential part constituting the ink jet recording head.

Referring to FIG. 3A, the ink jet recording head comprises the recording element substrate 300, an ink flow channel forming member 102, a wiring board 103 and a tank holder 150.

The ink flow channel forming member 102 is provided with a plurality of ink flow channels. The tank holder 150 detachably holds ink tanks for feeding ink to the ink flow channel forming member 102. The ink jet recording head and the ink tanks may as well be provided in an integrated form.

The recording element substrate 300 is fixed to the ink flow channel forming member 102 so that electric wiring provided in the substrate 20 of the recording element substrate 300 be connected to the wiring board 103 and the ink feed holes 31 through 34 of the recording element substrate 300 communicate with the plurality of ink flow channels which the ink flow channel forming member 102 has.

FIG. 3B shows a perspective view of an ink jet recording head 100 in a state in which an ink tank 200C, an ink tank 200M, an ink tank 200Y and an ink tank 200K are held by the tank holder 150. Incidentally in FIG. 3B, elements having the same configurations as in FIG. 3A are denoted by respectively the same reference signs.

Referring to FIG. 3B, the ink tank 200C holds ink of cyan (C); the ink tank 200 M, ink of magenta (M); the ink tank 200Y, ink of yellow (Y); and the ink tank 200K, ink of black (K).

When an electric connection unit 101 provided in the wiring board 103 is connected to the electric connection unit of the ink jet recording apparatus mounted with the ink jet recording head, the recording element substrate 300 is enabled to receive a drive signal supplied from the electric connection unit via the wiring board 103.

When the recording element substrate 300 receives the drive signal, the heat generating resistor 50 to which the received drive signal is supplied is driven, ink supplied from the ink tank via the ink flow channel forming member 102 is discharged from the discharge ports 10 disposed in positions matching the driven heat generating resistor 50, and recording is thereby performed.

In recent years, further improvement in picture quality, especially in terms of the definition and contrast of recorded pictures, has come to be required of color ink jet recording apparatuses using such ink jet recording heads as are described above. Extensively known ways to meet this requirement include enhancing the definition of pictures by increasing the densities of dye of inks.

However, as the densities of dye of inks are increased, they become more viscous.

Figure 4:
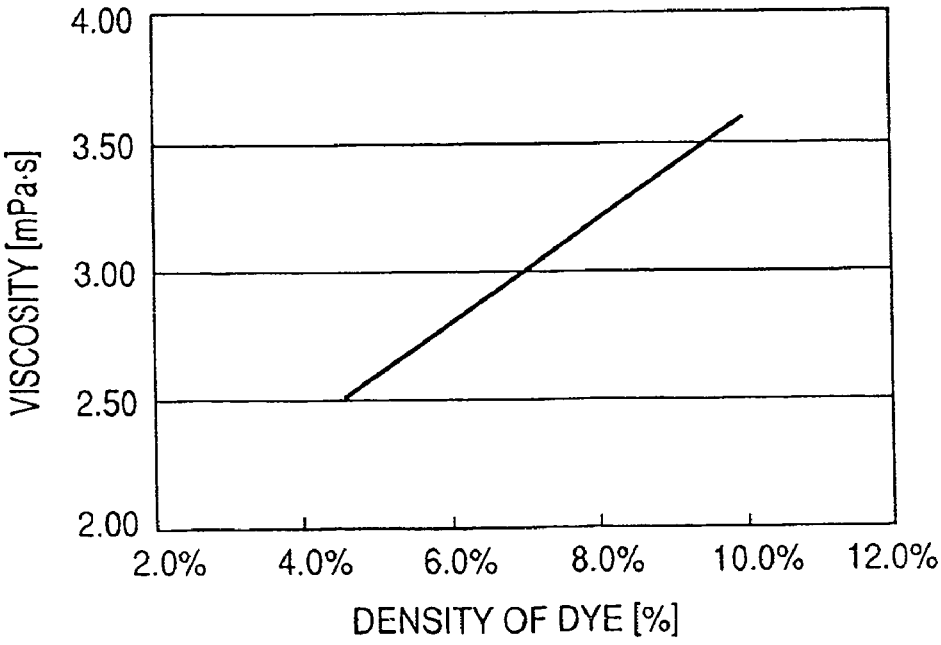
FIG. 4 illustrates the relationship between the density of dye and the viscosity of ink.

FIG. 4 illustrates the relationship between the density of dye of a certain ink and its viscosity. As shown in FIG. 4, where the density of dye of the ink is 4.5% for instance, its viscosity is about 2.5 mPa·s, but if the density of dye of the ink increases to 6%, its viscosity will rise to around 2.7 mPa·s.

As the ink's own viscosity increases and further raised by the influences of the temperature and humidity of the external environment to surpass a certain limit, if it is attempted to execute recording by discharging ink drips, the discharge of first drips of ink from the discharge ports will become unstable. Eventually, it may become impossible to normally form main drips of ink, or faulty discharging may occur as a consequence of the deviation of the discharging direction of ink drips from the designed discharging direction or a total failure to discharge ink drips.

An effective way to eliminate discharge failure due to the viscosity of ink and achieve stable discharging is to increase the temperature of the recording element substrate 300 when the viscosity of ink is above a prescribed level and thereby to reduce the viscosity of ink.

In the ink jet recording head in this embodiment, a plurality of discharge ports 10 are provided as shown in FIG. 1, and they constitute the discharge port arrays 11 through 14, arranged in the scanning direction at a prescribed pitch in the same recording element substrate 300. Where a plurality of discharge port arrays are disposed in the same recording element substrate 300 as in this case, it is made possible to prevent heat from being transmitted unevenly within the same recording element substrate.

Referring to FIG. 1, the discharge port arrays 11 disposed in the central area of the recording element substrate 300 (for instance, where the plurality of discharge port arrays are so disposed as to be in a prescribed order, the part containing the discharge port arrays which come at the center of the arrangement of the discharge port arrays) have adjoining their both ends other discharge port arrays which become heat sources (the discharge port arrays 12 and 14). Accordingly, heat is more difficult to escape from the central discharge port arrays in the arrangement of discharge port arrays than from the discharge port array 12 and discharge port arrays 13 which are at the ends.

To add, if the number of discharge port arrays in this embodiment is even, "the discharge port arrays which come at the center of the arrangement of the discharge port arrays" shall be either or both of the two discharge port arrays 11 and 14 which come at the center of the arrangement of the discharge port arrays.

Therefore, heat is more difficult to escape from the discharge port arrays 14 arranged in the central area of the recording element substrate 300, as they have on both of their adjoining sides heat generating discharge port arrays (the discharge port arrays 11 and the discharge port arrays 13), than from the discharge port arrays 12 and the discharge port arrays 13 which are at the ends in the arrangement of discharge port arrays.

Or when ink drips are discharged at the same time from all of the plurality of discharge port arrays and required recording is performed afterwards as in pre-discharging for stable ink discharging (ink discharging not intended for the execution of recording) for instance, discharge port arrays positioned between two pairs of discharge port arrays (the discharge port arrays 11 and the discharge port arrays 14 in this embodiment), the temperature more readily rises therein and heat is more difficult to escape from them than from discharge port arrays at the ends in the arrangement of discharge port arrays (the discharge port arrays 12 and the discharge port arrays 13 in this embodiment), as they have on both of their adjoining sides heat generating discharge port arrays.

Therefore, when ink drips are discharged at the same time from all of the plurality of discharge port arrays, the temperature in the part of the recording element substrate 300 close to the discharge port arrays positioned between two pairs of discharge port arrays becomes higher than elsewhere in the recording element substrate 300 close to discharge port arrays at the ends in the arrangement of discharge port arrays.

After ink drips are discharged at the same time from the plurality of discharge port arrays, heat dissipation from the discharge port arrays matched with the most viscous ink is less than that from the discharge port arrays which are at the ends of the plurality of discharge port arrays.

In this embodiment, the discharge port arrays discharging the ink of the color of the viscosity most susceptible to unstable discharging or inks of a highly viscous type when recording is to be performed on a recording medium using inks of a plurality of colors or a plurality of types are arranged between two discharge port arrays whose temperature is very likely to become higher than other areas in the recording element substrate 300.

To add, in this embodiment, the discharge port arrays discharging the ink of a color of high viscosity or the ink of a highly viscous type are positioned to be the central arrays in the arrangement of discharge port arrays (in this embodiment either the discharge port arrays 11 or the discharge port arrays 14; hereinafter they are supposed to be the discharge port arrays 11). Incidentally, the discharge port arrays which come at the center of the arrangement of the discharge port arrays are very likely to be higher in temperature than the area where other discharge port arrays are present in the recording element substrate 300.

In this embodiment, since the heat generating resistance devices matched with the two discharge port arrays adjacent to the discharge port arrays discharging the most viscous ink or the region of the recording element substrate in which those heat generating resistance devices are disposed can be utilized as the heat sources for the most viscous ink, it is easier to raise the temperature of the most viscous ink to reduce the viscosity of the ink than in a case where, for instance, the discharge port arrays discharging the most viscous ink are arranged at the ends of the plurality of parallel discharge port arrays, and it is thereby made possible to eliminate faulty discharging of ink drips.

Incidentally, this embodiment uses inks of different colors including cyan, magenta, yellow and black in forming a picture on a recording medium such as paper by discharging ink drips thereon.

Black ink is required to be enhanced in OD value in order to improve the clarity of recorded pictures. To meet this requirement, the OD value is enhanced in this embodiment by raising the density of dye of black ink. As the black ink is accordingly higher in the density of dye, it has a composition of higher viscosity than other inks.

For instance, the viscosities of cyan, magenta and yellow inks used in this embodiment are around 2.2 mPa·s, that of the black is 2.7 mPa·s, 1.2 times or even more compared with the viscosities of the inks of other colors. To add, though the viscosity of the most viscous one among the plurality of inks need not be higher than the viscosities of other inks, specifically by 1.2 times or more, the greater the difference in viscosity in this comparison, the higher the definition and the contrast of the recorded pictures that can be obtained.

In the discharge port arrays 11 through 14 of the recording element substrate 300 in this embodiment, the outer discharge port arrays 12 and 13 are respectively matched with cyan (C) and magenta (M), while the inner discharge port arrays 11 and 14 are respectively matched with black (K) and yellow (Y).

Therefore, black ink is supplied from the ink tank 200K to the ink feed hole 31, yellow ink from the ink feed hole 34 to the ink tank 200Y, magenta ink from the ink tank 200M to the ink feed hole 33, and cyan ink from the ink tank 200C to the ink feed hole 32.

Therefore, ink drips of cyan are discharged from the discharge port arrays 12, ink drips of magenta from the discharge port arrays 13, and ink drips of yellow from the discharge port arrays 14. On the other hand, the discharge port arrays 11, whose temperature rises above those of the discharge port arrays 12 and 13, discharge drips of black ink, which is the most viscous among the plurality of inks.

The drips of black ink, which is the most viscous among the plurality of inks, may as well be discharged from the discharge port arrays 14.

Also, the configuration may be such that the three other discharge port arrays than those which discharge black ink discharge any of the three other inks including cyan ink, magenta ink and yellow ink, whose viscosities are about equal.

This embodiment, since the most viscous one out of the plurality of inks is discharged from the discharge port arrays whose temperature is likely to become higher than those of the other discharge port arrays by reason of the structure of the ink jet recording head, for instance discharge port arrays arranged between two discharge port arrays, or more specifically the central ones in the arrangement of discharge port arrays, can obviate the usually experienced faulty discharging due to the most viscous ink, perform more stable discharging and provide finer pictures.

Further, as the ink of the highest density of dye among the plurality of inks is used as the most viscous one among the plurality of inks, even if inks of densities of dye exceeding the prescribed viscosity are used to enhance the definition and contrast of recorded pictures, ink drips can be stably discharged.

Incidentally, this embodiment is not confined to an ink jet recording head in which discharge port arrays are arranged at a prescribed pitch in the scanning direction of moving means, such as a carriage, for moving the ink jet recording head relative to the recording medium, but may as well be in a form in which the plurality of discharge port arrays extend in a direction crossing the carried recording medium. It may also be an ink jet recording head having the discharge port arrays arranged as described below.

Figure 5:
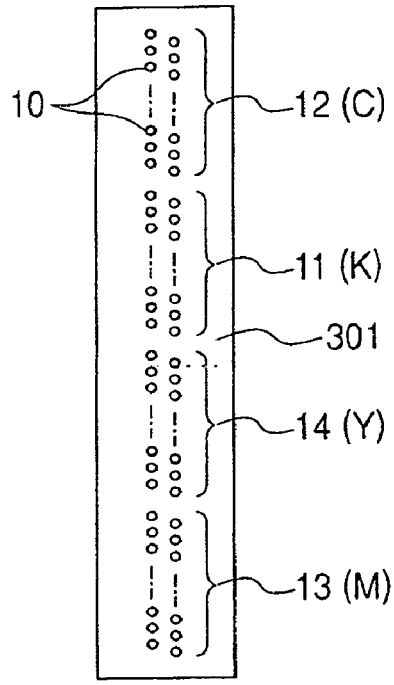
FIG. 5 illustrates another form of the essential part of the ink jet recording head, which is the first preferred embodiment of the invention.

FIG. 5 shows a plan of another example of ink jet recording head, more specifically an example in which discharge port arrays having the discharge ports 10 arranged in the vertical scanning direction of the ink jet recording head (specifically, the discharge port arrays 11 through 14) are arranged in a recording element substrate 301 in series to the vertical scanning direction of the ink jet recording head. Incidentally, in FIG. 5, elements having the same configurations as in FIG. 1 are denoted by respectively the same reference signs.

Referring to FIG. 5, in the recording element substrate 301, a plurality of discharge port arrays (specifically, the discharge port arrays 11 through 14) are arranged in series to the vertical scanning direction of the ink jet recording head.

The discharge port arrays 11 through 14 are respectively supplied with inks of black (K), cyan (C), magenta (M) and yellow (Y).

In this embodiment, the discharge port arrays 11 which discharge black ink of which the density of dye is high and the viscosity is the highest among the four kinds of ink are the central discharge port arrays in the arrangement of discharge port arrays. In other words, the discharge port arrays 11 discharging black ink, which is the most viscous among the plurality of inks, are arranged between the other discharge port arrays arranged in the serial direction in the recording element substrate 301.

This embodiment shown in FIG. 1 or FIG. 5, since the heat generating resistance devices matched with the two discharge port arrays adjacent to the discharge port arrays discharging the most viscous ink or the region of the recording element substrate in which those heat generating resistance devices are disposed are utilized as the heat sources for the most viscous ink for discharging ink from the discharge ports, can be simplified in configuration compared with a configuration in which dedicated heat sources are provided for the recording element substrate.

(Second Embodiment)

Figure 6:
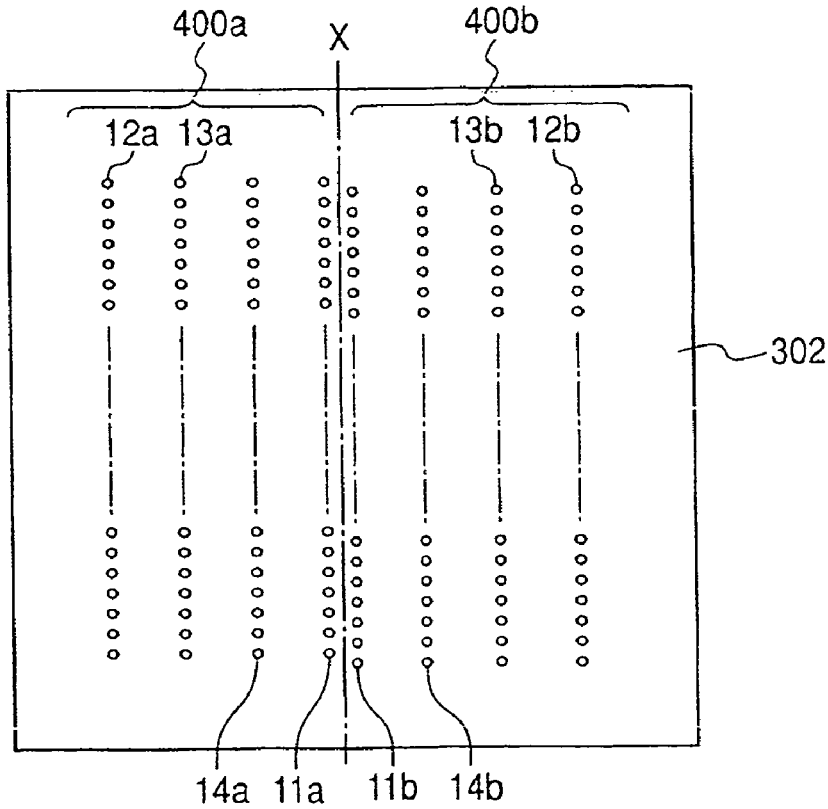
FIG. 6 illustrates one form of the essential part of an ink jet recording head, which is a second preferred embodiment of the invention.

FIG. 6 is a plan showing the essential part of an ink jet recording head, which is a second preferred embodiment of the invention. Incidentally in FIG. 6, elements having the same configurations as in FIG. 1 are denoted by respectively the same reference signs.

Referring to FIG. 6, in a recording element substrate 302, there are disposed a first discharge port array group 400*a* comprising first discharge port arrays 11*a*, 14*a*, 13*a* and 12*a* and a second discharge port array group 400*b* comprising second discharge port arrays 11*b*, 14*b*, 13*b* and 12*b*.

The first discharge port array group 400*a* is disposed in a position deviating by a prescribed distance in the vertical scanning direction of the ink jet recording head from a position where it is axially symmetric to the second discharge port array group 400*b* with respect to a straight line X in the same direction as that vertical scanning direction. Therefore, when bidirectional recording is to be accomplished, as it can be done in the same sequence as that of discharging a plurality of inks onto the recording medium, color shading due to the sequence of ink application, which would otherwise occur in bidirectional recording, can be eliminated.

To add, this embodiment uses as the aforementioned prescribed distance half of the distance between adjacent discharge ports in the plurality of discharge ports constituting one discharge port arrays. The position of the i-th discharge port from one end of each of the discharge port arrays 11*a* through 14*a* is so determined that the recording element substrate 302 moving in the scanning direction pass the same point. Also, the position of the i-th discharge port from one end of each of the discharge port arrays 11*b* through 14*b* is so determined that the recording element substrate 302 moving in the scanning direction pass the same point.

Therefore, the first discharge port arrays in the first discharge port group and the second discharge port arrays in the second discharge port group discharging the same kind of ink are so arranged, when moving in the scanning direction, that individual discharge ports interpolate other discharge ports of the discharge port arrays, with the result that recording can be accomplished in the vertical scanning direction in a density double that of discharge ports in each discharge port array.

This embodiment has a configuration in which the ink highest in the density of dye and in viscosity among the plurality of inks is discharged by the discharge port arrays 11*a* and the discharge port arrays 11*b* which come at the center of the arrangement of the discharge port arrays, the ink next highest in viscosity is discharged by the discharge port array 14*a* and the discharge port arrays 14*b*, the ink third highest in viscosity is discharged by the discharge port array 13*a* and the discharge port array 13*b*, and the ink lowest in viscosity among the plurality of inks is discharged by the outermost discharge port array 12*a* and the discharge port array 12*b*.

For instance where the viscosity levels of the inks of cyan (C), magenta (M), yellow (Y) and black (K) are cyan (C) <magenta (M) <yellow (Y) <black (K), the outermost discharge port arrays 12*a* and 12*b* discharge the ink of cyan (C), the discharge port arrays 13*a* and 13*b*, the ink of magenta (M), the discharge port arrays 14*a* and 14*b*, the ink of yellow (Y), and the innermost mutually adjacent discharge port arrays 11*a* and 11*b*, the ink of black (K), containing the most viscous dye among the plurality of inks.

This embodiment is so configured that the most viscous ink among the plurality of inks is discharged from the discharge port arrays 11*a* and 11*b* which come to the center in the arrangement of discharge port arrays, and the viscosity of ink discharged from given discharge port arrays decreases as the discharge port arrays are farther away from the center and near either end in the arrangement of discharge port arrays. Since the temperature is likely to fall from the central toward the end discharge port arrays in the arrangement of discharge port arrays, (when ink drips are discharged at the same time from all of the plurality of discharge port arrays and recording is performed afterwards as in pre-discharging, for instance) it is made possible to have more viscous ink to be discharged from higher-temperature discharge port arrays and thereby to achieve stable ink discharging.

To add, regarding the whole plurality of discharge port arrays, specifically the discharge port arrays 11*a*, 11*b*, 12*a*, 12*b*, 13*a*, 13*b*, 14*a* and 14*b* in this embodiment, the discharge port arrays belonging to the first discharge port array group 400*a* are disposed in a position deviating by a prescribed distance in a direction orthogonal to the scanning direction of the ink jet recording head from a position where they are axially symmetric to the discharge port arrays belonging to the second discharge port array group 400*b* with respect to a straight line orthogonal to the scanning direction of the ink jet recording head, but the minimum required number of discharge port arrays to be arranged in this manner is two (an arrangement in which one discharge port array in the first discharge port array group 400*a* and one discharge port array in the second discharge port array group 400*b* match each other).

Figure 7:
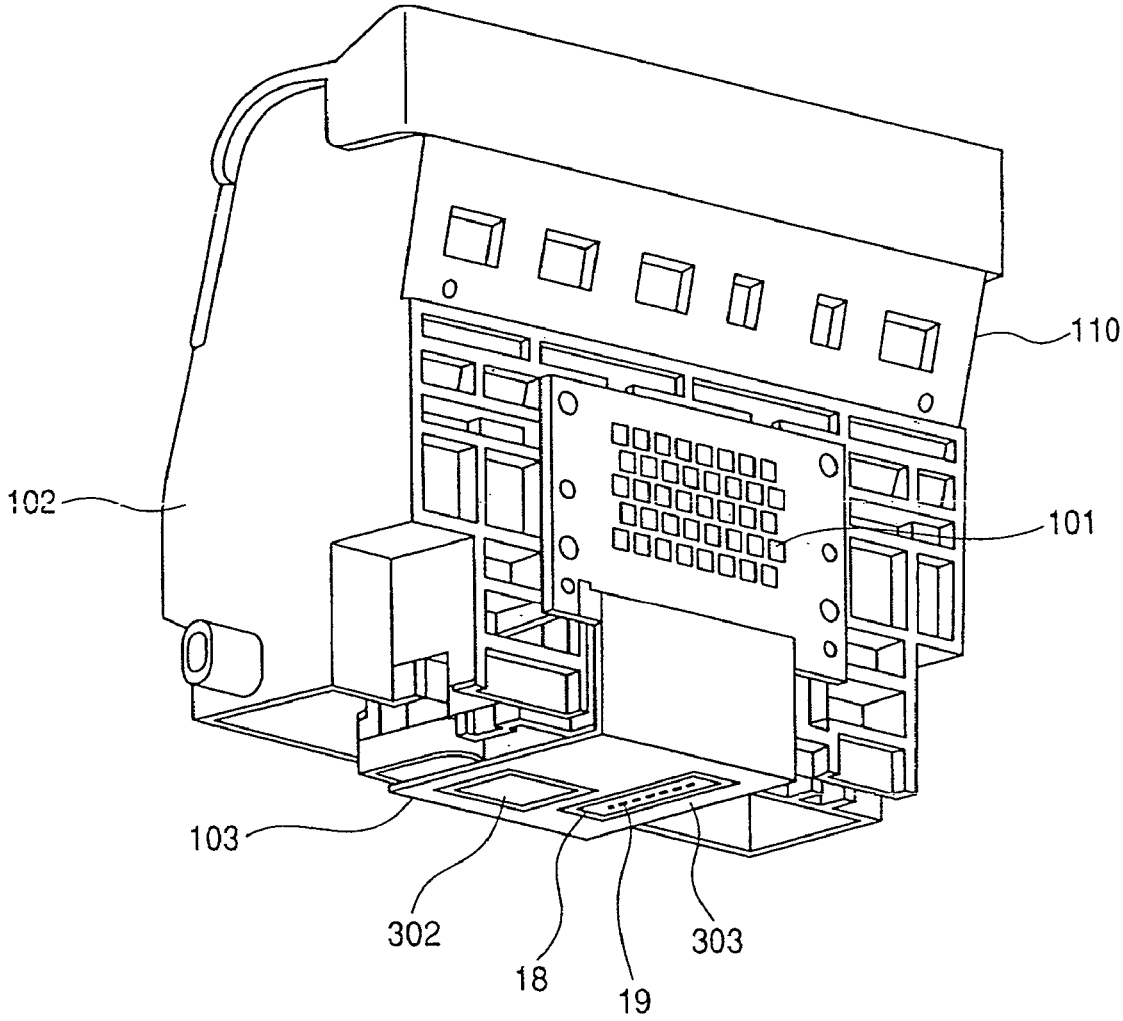
FIG. 7 illustrates one example of the ink jet recording head, which is the second preferred embodiment of the invention.

FIG. 7 shows a perspective view of the essential part of the ink jet recording apparatus to be mounted with the recording element substrate shown in FIG. 6, more specifically an ink jet recording head 110 to be mounted with the recording element substrate shown in FIG. 6. Incidentally in FIG. 7, elements having the same configurations as in FIGS. 3A and 3B are denoted by respectively the same reference signs. It has to be noted, however, that ink flow channels for cyan (C), magenta (M), yellow (Y) and dye black (K) and an ink flow channel for pigment black ink (Bk) are formed in the ink flow channel forming member 102.

Referring to FIG. 7, to the ink flow channel forming member 102 are fixed the recording element substrate 302 capable of discharging inks of cyan (C), magenta (M), yellow (Y) and black (K) and a recording element substrate 303 provided with discharge port arrays 18 and discharge port arrays 19 for discharging pigment black ink (Bk). Therefore, this embodiment constitutes an ink jet recording head capable of discharging five different kinds of ink. In this case, the addition of the recording element substrate 303 enables a greater variety of inks to be used than in the absence of the recording element substrate 303.

To add, the nozzles for discharging pigment black ink are provided in a greater number than those for discharging the ink of any other single color to increase the speed of monochromic recording. In this embodiment, the discharge port arrays 18 and the discharge port arrays 19 for pigment black ink (Bk), like the discharge port array group 400*a* and the discharge port array group 400*b*, are so arranged that, when moving in the scanning direction, individual discharge ports interpolate other discharge ports of the discharge port arrays, with the result that recording can be accomplished in the vertical scanning direction in a density double that of discharge ports in each discharge port array.

Although in this embodiment, only the recording element substrate 303 is provided with discharge port arrays for discharging pigment black ink (Bk), the discharge port arrays for discharging pigment black ink (Bk) may as well be disposed over the recording element substrate 302 alone, or in both the recording element substrate 302 and the recording element substrate 303.

Figure 8:
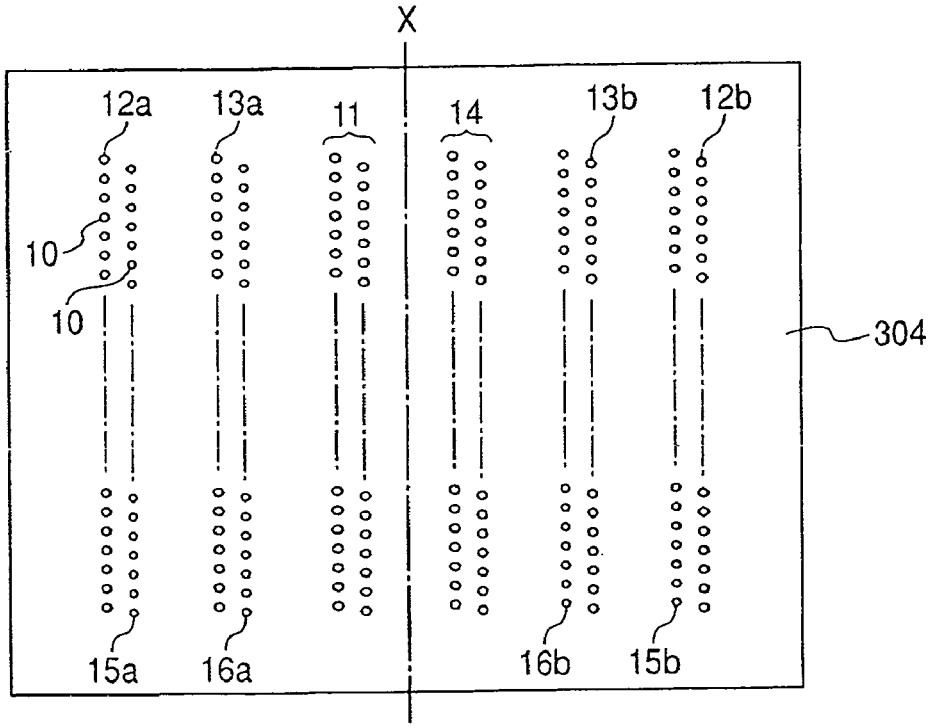
FIG. 8 illustrates another form of the essential part of the ink jet recording head, which is the second preferred embodiment of the invention.

FIG. 8 is a plan showing another form of this embodiment. Incidentally in FIG. 8, elements having the same configurations as in the preceding figure are denoted by respectively the same reference signs.

What is shown in FIG. 8 is an example in which discharge port arrays for discharging ink of either one of cyan (C) and magenta (M), which are used for the formation of secondary colors and tend to be conspicuously grainy, are so arranged over a recording element substrate as to be in substantial axial symmetry to the straight line X in the same direction as the vertical scanning direction of the ink jet recording head, and the inks of cyan (C) and magenta (M) can be discharged in variable volumes.

Referring to FIG. 8, discharge port arrays 12*a*, 12*b*, 15*a* and 15*b* are intended for discharging the ink of cyan (C).

The discharge port array 12*a* and 12*b* comprise discharge ports for discharging ink in volumes of 5 pl.

The discharge port array 12*a* is disposed in a position deviating by a prescribed distance (half the distance between adjoining discharge ports in the discharge port array 12*b*) in the vertical scanning direction of the ink jet recording head from a position where they are axially symmetric to the discharge port array 12*b* with respect to a straight line X in the same direction as the vertical scanning direction of the ink jet recording head. Therefore, recording by using the discharge port arrays 12*a* and 12*b* can be accomplished in a density double the density of discharge port arraying in each discharge port array in the vertical scanning direction.

The discharge port arrays 15*a* and 15*b* comprise discharge ports for discharging ink in volumes of 2 pl for instance.

The discharge port array 15*a* is disposed in a position deviating by a prescribed distance (half the distance between adjoining discharge ports in the discharge port array 15*b*) in the vertical scanning direction of the ink jet recording head from a position where they are axially symmetric to the discharge port array 15*b* with respect to a straight line X in the same direction as the vertical scanning direction of the ink jet recording head. Therefore, recording by using the discharge port arrays 15*a* and 15*b* can be accomplished in a density double the density of discharge port arraying in each discharge port array in the vertical scanning direction.

Also, discharge port arrays 13*a*, 13*b*, 16*a* and 16*b* for discharging the ink of magenta (M) are arranged in a similar sequence to the discharge port arrays 12*a*, 12*b*, 15*a* and 15*b* inside the discharge port arrays 12*a*, 12*b*, 15*a* and 15*b* for discharging the ink of cyan (C).

Further inside them, there are disposed the discharge port arrays 14 for discharging the ink of yellow (Y) and the discharge port arrays 11 for discharging the ink of black (K), whose viscosity is the highest.

This embodiment, since the ink of the same kind is discharged in a variety of volumes, can prevent the grainy state of ink drips imprinted on the recording medium from becoming too conspicuous.

Also in this embodiment, the ink jet recording head having a plurality of discharge port arrays for discharging ink of the same kind to be in substantial axial symmetry to the straight line X in the same direction as the vertical scanning direction of the ink jet recording head has an arrangement in which the most viscous ink is discharged from the discharge port arrays which come to the center in the arrangement of discharge port arrays, which are likely to have the highest temperature and the most difficult for heat to escape from among the plurality of discharge port arrays arranged. This arrangement makes it possible to stably discharge the highly viscous ink which is more likely to invite faulty discharging than other inks.

To add, while in this embodiment, the discharge port arrays which discharge the inks matching them in a variety of volumes are supposed to be the discharge port arrays for discharging the ink of magenta (M) and the discharge port arrays for discharging the ink of cyan (C), the discharge port arrays which discharge inks matching them in a variety of volumes are not limited to these but can altered to some others as appropriate. For instance, at least one of the plurality of discharge port arrays may be enabled to discharge the ink matching them in a variety of volumes.

Further in this embodiment, though the discharge port arrays which discharge the most viscous ink are supposed to be the discharge port arrays which come to the center in the arrangement of discharge port arrays, they are not confined to the central discharge port arrays, but the discharge port arrays for discharging the most viscous ink may be any pair of discharge port arrays disposed between two pairs of discharge port arrays.

(Third Embodiment)

Figure 9:
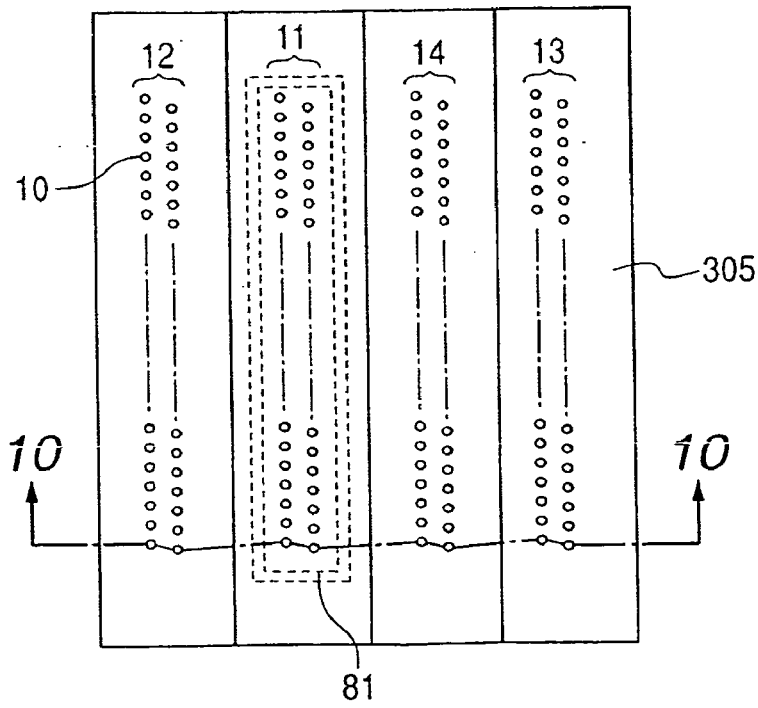
FIG. 9 illustrates one form of the essential part of an ink jet recording head, which is a third preferred embodiment of the invention.
Figure 10:
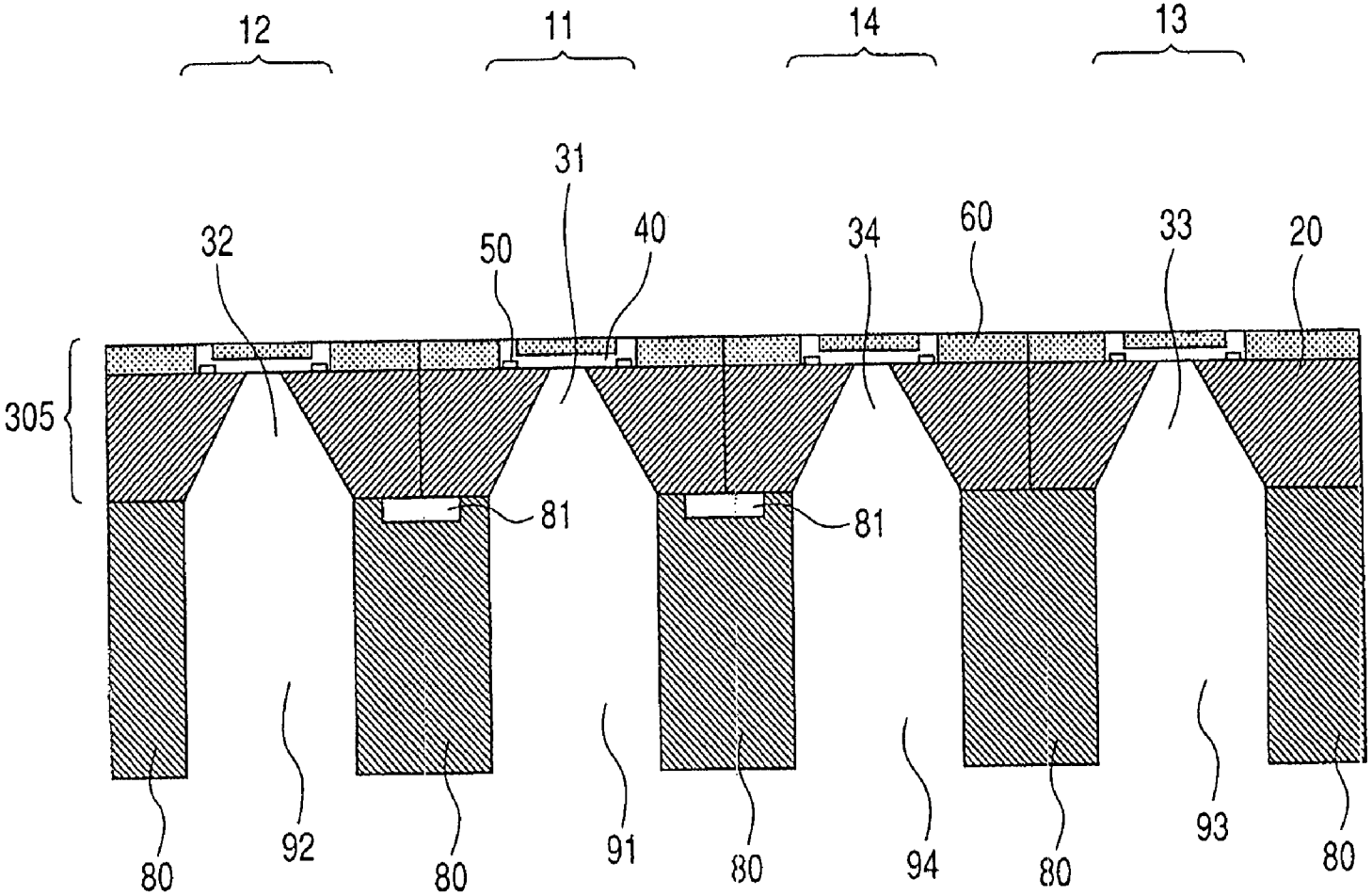
FIG. 10 shows a section of the essential part of the ink jet recording head shown in FIG. 9.

FIG. 9 and FIG. 10 illustrate an ink jet recording head, which is a third preferred embodiment of the invention. FIG. 9 shows a plan of the essential part of the ink jet recording head, and FIG. 10, a section along line 10—10 in FIG. 9. Incidentally in FIG. 9 and FIG. 10, elements having the same configurations as in the preceding figure are denoted by respectively the same reference signs.

In this embodiment, heat radiator plates 80 to prevent the temperature of recording element substrates 305 from rising are disposed in an ink jet recording head in which discharge port arrays are arranged (see FIG. 10).

Referring to FIG. 9, the recording element substrates 305 are independently provided for inks of different colors.

Referring to FIG. 10, the heat radiator plates 80 are in contact with the recording element substrates 305, and have openings 91 through 94 respectively matching ink feed holes 31 through 34 in the recording element substrates 305.

Further, as shown in FIG. 9 and FIG. 10, the heat radiator plates 80 are so configured as to keep the discharge port arrays 11 for discharging the most viscous ink lagging behind other nozzle arrays in heat dissipation and higher in temperature than the others by surrounding the discharge port arrays 11 for discharging the most viscous ink with a groove 81.

As in this embodiment the efficiency of heat dissipation by the heat radiator plates matching the discharge port arrays for discharging the most viscous ink is kept inferior to that of other discharge port arrays than the discharge port arrays for discharging the most viscous ink, the temperature of the discharge port arrays for discharging the most viscous ink can be kept higher than that of other discharge port arrays, and it is thereby made possible to stably discharge the highly viscous ink which is more likely to invite faulty discharging than other inks.

When ink drips not for recording use are discharged at the same time from all of the plurality of discharge port arrays with a view to stabilizing ink discharging as in pre-discharging for instance, discharge port arrays disposed between two discharge port arrays are more susceptible to temperature rise and difficult to let heat escape than from discharge port arrays at the ends in the arrangement of discharge port arrays, because the discharge port arrays on the two sides become heat sources. Therefore, when ink drips are discharged at the same time from all of the plurality of discharge port arrays, heat dissipation from the discharge port arrays matching the most viscous ink is less than that from the discharge port arrays at the ends in the plurality of discharge port arrays, and the temperature in the vicinity of the most viscous ink is kept higher than that in the vicinities of the discharge port arrays at the ends. By performing recording after that, it is made possible to stably discharge the high viscosity ink which is more likely to invite faulty discharging than other inks.

To add, the heat radiator plates such as those shown in FIG. 9 and FIG. 10 can as well be used in the first or second preferred embodiment described earlier.

(Fourth Embodiment)

Figure 11:
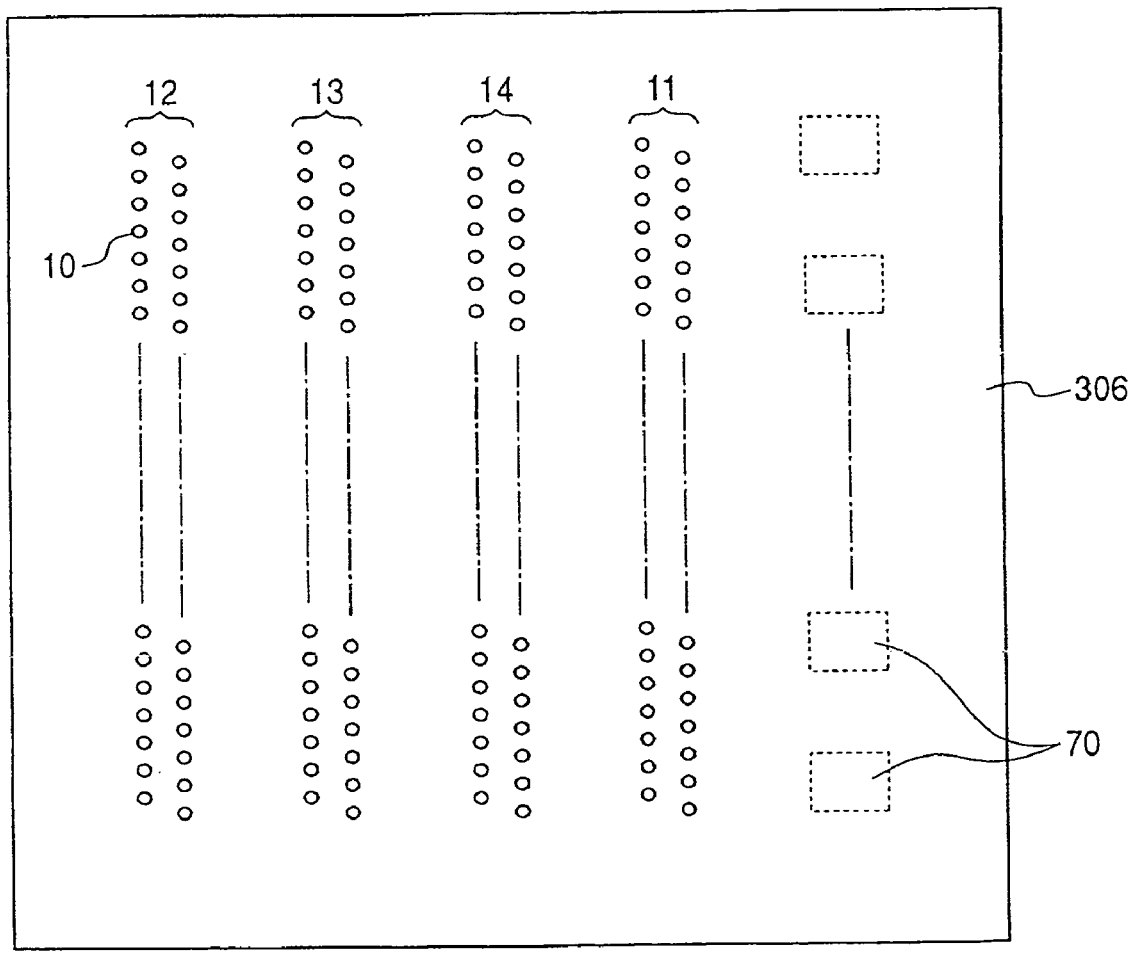
FIG. 11 illustrates one form of the essential part of an ink jet recording head, which is a fourth preferred embodiment of the invention.

FIG. 11 is a plan showing the essential part of an ink jet recording head, which is a fourth preferred embodiment of the invention. Incidentally in FIG. 11, elements having the same configurations as in FIG. 1 are denoted by respectively the same reference signs.

In this embodiment, one or more sub-heaters 70 are further disposed as one or more heat supply units to control the temperature of a recording element substrate 306 in the ink jet recording head in which discharge port arrays are arranged. (The term "heat supply unit" may refer to one or a plurality of sub-heaters 70.)

Referring to FIG. 11, the sub-heaters 70 are provided to prevent faulty discharging, which is likely to accompany discharging of ink drips in a low temperature environment, for example, and they are used to raise the temperature of the recording element substrate 306 before supplying a drive current to the heat generating resistance devices 50 for discharging ink drips.

In the recording element substrate 306, the temperature in the vicinities of the sub-heaters 70 becomes the highest on account of heating by the sub-heaters 70. Therefore in this embodiment, the discharge port arrays for discharging the most viscous ink are disposed closest to the sub-heaters 70 among the plurality of discharge port arrays, and it is thereby made possible to stably discharge the highly viscous ink which is more likely to invite faulty discharging than other inks.

In this embodiment, unlike in the first, second and third preferred embodiments, the discharge port arrays for discharging the most viscous ink may constitute the discharge port arrays at the ends in the arrangement of discharge port arrays.

Although in the embodiments described above the types of liquid (ink) used for recording are supposed to be cyan, magenta, yellow and black, which are most frequently used in the field of ink jet recording, the plurality of inks to be used are not limited to these, but can be altered as appropriate by, for instance, adding ink of another color. The most viscous ink can be the ink of the highest density of dye among the plurality of inks used, and can be some other ink than black ink.

The number of pairs of discharge port arrays can be any number not smaller than three.

The ink jet recording head 100 is so mounted on an ink jet recording apparatus that the arraying direction of the discharge ports constituting each discharge port arrays (i.e., the direction of each individual discharge port arrays) be different from the aforementioned scanning direction, and recording is accomplished by discharging liquid (ink) from these discharge port arrays.

An ink jet recording apparatus mounted with any of the ink jet recording heads described above as preferred embodiments of the invention is enabled to stably discharge ink drips.

The illustrated configurations of the embodiments described above are mere examples, and the invention is not limited to these configurations.

For instance, though heat generating resistance devices are used as recording elements for discharging ink from the discharge ports in every embodiment described above, the recording elements need not be heat generating resistance devices, but piezo devices can be used as discharging energy generating elements if only they can discharge from the discharge ports of the discharge port arrays inks respectively matching those discharge port arrays and supply heat to the areas around the ink discharge ports in the first recording element substrate.

This application claims priority from Japanese Patent Application No. 2003-363269 filed on Oct. 23, 2003, which is hereby incorporated by reference herein.

What is claimed is:

1. An ink jet recording head comprising:

a plurality of discharge port arrays each comprising a plurality of discharge ports, each of the discharge port arrays corresponding to one or another of a plurality of types of ink whose viscosity decreases with a rise in temperature;

recording elements to generate energy for discharging inks from the discharge ports of said discharge port arrays, the inks respectively corresponding to the discharge port arrays;

a recording element substrate provided with said discharge port arrays and said recording elements; and a heat supply unit for supplying heat to regions of said recording element substrate close to the discharge port arrays corresponding to the most viscous ink among the inks corresponding to said plurality of discharge port arrays.

2. An ink jet recording apparatus comprising:

an ink jet recording head according to claim 1; and means of moving said ink jet recording head toward a recording medium.

* * * * *

UNITED STATES PATENT AND TRADEMARK OFFICE

CERTIFICATE OF CORRECTION

PATENT NO. : 7,175,255 B2
APPLICATION NO. : 10/926959
DATED : February 13, 2007
INVENTOR(S) : Kazuhiko Okita et al.

It is certified that error appears in the above-identified patent and that said Letters Patent is hereby corrected as shown below:

COLUMN 3
Line 48, “little varies” should read --varies little--.
Line 55, “hole” should read --holes--.
Line 56, “hole” should read --holes--.

COLUMN 4
Line 26, “referred” should read --referred to--.

COLUMN 5
Line 25, “and” should read --and is--.

COLUMN 7
Line 28, “feed hole 34” should read --tank 200Y,--.
Line 29, “tank 200Y,” should read --feed hole 34,--.

COLUMN 11
Line 52, “altered” should read --be altered--.

Signed and Sealed this

Twenty-fifth Day of December, 2007

JON W. DUDAS
*Director of the United States Patent and Trademark Office*